US010302099B2

(12) United States Patent
Santucci

(10) Patent No.: US 10,302,099 B2
(45) Date of Patent: May 28, 2019

(54) EXTRACTION HOOD

(71) Applicant: Whirlpool EMEA S.p.A., Pero (IT)

(72) Inventor: Mauro Santucci, Fabriano (IT)

(73) Assignee: Whirlpool EMEA S.p.A., Pero (IT)

( * ) Notice: Subject to any disclaimer, the term of this patent is extended or adjusted under 35 U.S.C. 154(b) by 177 days.

(21) Appl. No.: 14/972,914

(22) Filed: Dec. 17, 2015

(65) Prior Publication Data

US 2016/0177972 A1 Jun. 23, 2016

(30) Foreign Application Priority Data

Dec. 22, 2014 (IT) ..... TO2014A1084

(51) Int. Cl.

| | |
|---|---|
| ***F04D 29/62*** | (2006.01) |
| ***F04D 17/16*** | (2006.01) |
| ***F04D 25/06*** | (2006.01) |
| ***F04D 25/08*** | (2006.01) |
| ***F04D 29/28*** | (2006.01) |
| ***F04D 29/42*** | (2006.01) |

(Continued)

(52) U.S. Cl.

CPC ..... *F04D 29/624* (2013.01); *B08B 5/04* (2013.01); *F04D 17/16* (2013.01); *F04D 25/06* (2013.01); *F04D 25/08* (2013.01); *F04D 29/281* (2013.01); *F04D 29/4226* (2013.01); *F04D 29/4233* (2013.01); *F04D 29/626* (2013.01); *F24C 15/20* (2013.01)

(58) Field of Classification Search

CPC ..... F04D 17/16; F04D 25/06; F04D 25/08; F04D 29/281; F04D 29/4226; F04D 29/4233; F04D 29/624; F04D 29/626; B08B 5/04; F24C 15/20

USPC ..... 415/204, 206; 417/423.7, 423.14, 423.3, 417/423.1; 310/1

See application file for complete search history.

(56) References Cited

U.S. PATENT DOCUMENTS 3,746,289 A * 7/1973 Johnsen ..... H02K 5/00 248/674
3,941,339 A * 3/1976 McCarty ..... F04D 29/646 248/603

(Continued)

FOREIGN PATENT DOCUMENTS

EP 0 408 221 A2 1/1991
EP 0 598 684 A1 5/1994

OTHER PUBLICATIONS

Italian Search Report dated Sep. 1, 2015 for Italian Application No. TO2014A001084 filed on Dec. 22, 2014, 7 pages.

*Primary Examiner* — Steven B McAllister
*Assistant Examiner* — Ko-Wei Lin
(74) *Attorney, Agent, or Firm* — Cesari and McKenna, LLP

(57) ABSTRACT

The present invention relates to an adapter (404) for a suction device (401) comprising an electric motor (402) that drives an impeller (403) and further comprising a volute (201) that houses said electric motor (402) and said impeller (403), such adapter (404) comprising a substantially rectangular first shaped end (501) configured to engage with said electric motor (402), and further comprising a substantially circular second shaped end (502) configured to mate with the volute (201); the adapter (404) further comprises a plurality of through holes (503) for fastening the electric motor (402) to the volute (201).

Furthermore, the present invention relates to a related suction device (401) and a related range hood (101).

19 Claims, 5 Drawing Sheets

(51) Int. Cl.
*B08B 5/04* (2006.01)
*F24C 15/20* (2006.01)

(56) References Cited

U.S. PATENT DOCUMENTS

| | | | | |
|---|---|---|---|---|
| 3,966,363 | A * | 6/1976 | Rowley | F04D 13/06<br>417/423.11 |
| 5,879,232 | A * | 3/1999 | Luter, II | F04D 25/08<br>454/349 |
| 2003/0133815 | A1 | 7/2003 | Grant | |
| 2007/0114168 | A1* | 5/2007 | Hazlehurst | B01D 35/26<br>210/416.2 |
| 2011/0189033 | A1* | 8/2011 | Czulak | F04D 29/584<br>417/369 |

* cited by examiner

EXTRACTION HOOD

CROSS REFERENCE TO RELATED APPLICATIONS

This application claims priority to Italian Application No. TO2014A001084, filed on Dec. 22, 2014, the content of which is hereby incorporated by reference in its entirety.

TECHNICAL FIELD

The present invention relates to the field of hoods, in particular for treating smoke and odours in domestic environments, by way of example to range hoods.

In particular, the present invention relates to an adapter for a suction device for a hood, to a related suction device for a hood, and to a related range hood.

PRIOR ART

Nowadays, suction and/or filtering devices are known in the art, to be installed in proximity to the places where the generation of fumes or odours occurs. By way of example, these suction and/or filtering devices are known as "hoods" and are typically installed in domestic environments, such as a kitchen, in correspondence to cookers or stoves or general heating elements on which food is cooked.

Some hoods suck the smoke from the environment, discharging the sucked air into a ventilation duct, which evacuates smoke and odours outdoor; these hoods are thus known as "suction hoods".

Other hoods collect the smoke from the environment, for filtering them and re-entering the purified air in the same environment; this second type of hoods is known as "recirculating hoods".

Know hoods comprise one or more suction devices, typically constituted by a compressor or a fan, wherein an electric motor drives an impeller, which gives a priority to an air volume, increasing the pressure for moving it into a duct. Known hoods comprise an opening for the air inlet, connected to an extractor element, such as the chimney, and between the opening and the extractor element the suction device is inserted, assuring the operation of the hood.

Consequently, known hoods need an electric motor driving the impeller of the suction device, so that the hood can suck air.

A great diversity of electric motors is commercially available which, by way of example, differ each other in configuration, power and overall dimensions. To such different electric motors, different types of impeller may be associated, in particular differing each other in the overall dimensions and the geometrical features of the thread, which constitutes their aerodynamic elements.

Known suction devices, comprising an electric motor for driving the impeller, have some problems related precisely to the diversity of commercially available electric motors.

Indeed, in known suction devices, the volute housing the motor and the impeller are configured for a specific type of motor, giving rise to certain inner dimensions according to which the volute is shaped. Therefore, having to change the type of motor of the suction device, it is necessary to realise a different volute, with an increase in production costs, also for the realisation of different plastic moulding, by which the structure of the volute is realised.

In short, a drawback of the suctions devices known in the art is the lack of versatility and flexibility in the housing of different electric motors, although commercially available, inside the same type of volute.

OBJECTS AND SUMMARY OF THE INVENTION

It is an object of the present invention to solve some of the problems of the prior art.

In particular, it is an object of the present invention to provide a suction device that is more versatile than those of the prior art.

A further object of the present invention is to provide a suction device comprising an electric motor housed in the volute, wherein the housing of the electric motor is more effective.

It is another of the present invention to provide a suction device wherein the housing of the electric motor is alternative compared to the systems of prior art.

A further object of the present invention is to provide a suction device that is easier to realise, and wherein production costs are limited, realizing inter alia economies of scale.

These and other objects of the present invention are achieved through an adapter for a suction device, a suction device and a related suction hood, incorporating the features set out in the appended claims, which are intended to be an integral part of the present description.

The idea underlying the present invention consists in providing an adapter for a suction device, such suction device comprising an electric motor that drives an impeller, and further comprising a volute that houses the electric motor and the impeller; the adapter comprises a substantially rectangular first shaped end configured to engage with the electric motor, and further comprises a substantially rectangular second shaped end configured to mate with the volute, wherein the adapter further comprises a plurality of through holes for fastening the electric motor to the volute.

In this way, the adapter allows the assembly of a first type of electric motor in a volute, which in itself would be adapted to house a second different type of electric motor. The adapter allows to fasten the electric motor to the volute, assuring the perfect operation of the suction device. The adapter thus allows to exploit the same type of volute for housing several types of electric motors, with an increase in versatility and flexibility of the solution, reducing inter alia the production costs of the suction device to which the adapter may be associated.

Preferably, the adapter further comprises at least two guiding elements protruding from the second end, and being configured to be inserted into respective holes of the volute. In this way, the adapter and the electric motor with which it is engaged, are better guided in the assembly phase of the suction device.

Preferably, the adapter further comprises at least two hooking elements protruding from the second end, being configured to hook with respective holes of the volute, connecting the adapter to the volute during the assembly of the suction device. In this way, it is possible to hook the adapter with the volute during the assembly phase of the suction device, if it is necessary first of all to assemble the adapter to the volute and hook them only after the motor assembly.

Preferably, the through holes of the adapter comprise two slots, both of which have a substantially elliptical section and are so configured as to allow the passage of two respective screws of the electric motor, preferably with limited negative allowance between the inner slots and the thread of the screws. In this way, the coupling between the motor and the adapter is improved, as well as the assembly of the suction device.

Preferably, the first rectangular end of the adapter is configured to engage with an electric motor which has a substantially parallelepiped shape, while the second circular end of the adapter has a shape substantially similar to the shape of a different second electric motor which has a substantially cylindrical shape. In this way, the adapter allows to adapt a type of electric motor—which has precisely a parallelepiped shape—to a volute that is shaped, in itself, for housing a different type of electric motor—which has precisely a cylindrical shape.

A further idea underlying the present invention consists in providing a suction device, comprising an electric motor, an impeller driven by the electric motor, and a volute adapted to house the motor and the impeller, further comprising an adapter, according to the present invention.

Preferably, the suction device comprises an electric motor, which has a substantially parallelepiped shape, suitable for fitting into the first shaped end of the adapter, further comprising two protruding screws and configured to go through the adapter and be fastened to the volute.

Preferably, the volute comprises six holes arranged circumferentially on the surface, which is proximal to the second shaped end of the adapter. In particular, two of the six holes are configured to house screws protruding from the electric motor. Furthermore, in particular, each one of the remaining four holes is configured to alternately house: a guiding element or a hooking element of the adapter, or a screw for fastening a different second electric motor, having a substantially cylindrical shape, which is insertable into the suction device without using said adapter. In this way, the adapter insertion allows to adapt the volute to the first type of motor, whereas, in the absence of the adapter, the volute houses a second type of motor; the six holes into the volute make the assembly of the suction device more efficient and rational.

Preferably, the suction device further comprises cover elements configured for covering the screws, in particular made of metal, protruding from the volute so as to electrically insulate them, for greater safety.

The present invention also provides a related range hood, wherein the suction device, summarized above, is installed.

Other objects and advantages of the present invention will become more apparent from the detailed description provided hereafter, and from the attached drawings.

BRIEF DESCRIPTION OF THE DRAWINGS

Some examples of preferred and advantageous embodiments are supplied by way of non-limiting example, with reference to the attached figures, wherein.

The figures show different aspects and embodiments of the present invention and, where appropriate, structures, components, materials and/or similar elements in different figures are designated by the same reference numerals.

DETAILED DESCRIPTION OF THE INVENTION

Figure 1:
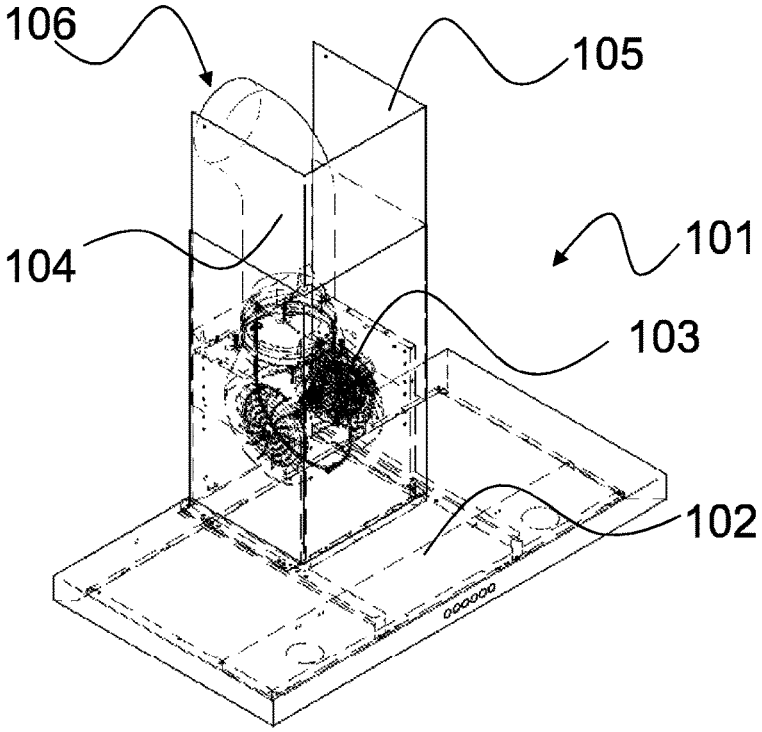
FIG. 1 shows a hood, according to the present invention.

FIG. 1 is an example of range hood 101, of the suction type, preferably fastened to the wall. In an alternative embodiment, by way of example, the range hood may be of the "island" type, i.e. fastened away from the walls of the room, and accessible on four sides.

The hood 101 comprises a smoke collector 102, which should be typically placed over a stovetop; the smoke collector 102 may comprise further filter elements (not shown), designated to filter the fat particles extracted from air, which are filters, according to the prior art.

The hood 101 further comprises a suction device 103, adapted to collect air from the smoke collector 102 and direct it into the extraction tube 104, which will be described in more detail below.

Preferably, the extraction tube 104 is protected by the aesthetic cover 105, which hides it from view of the users who are in the room where the hood 101 is arranged.

At the outlet of the extraction tube 104, i.e. at the top of the hood 101, an evacuation section 106 is located, such as a wall flange, typically available in the wall of the domestic environment wherein the hood 101 is installed.

Generally, the present invention is applicable to every type of hood (both to suction hoods and recirculation hoods) or suction system, in which a suction device is comprised, as described below.

Figure 2:
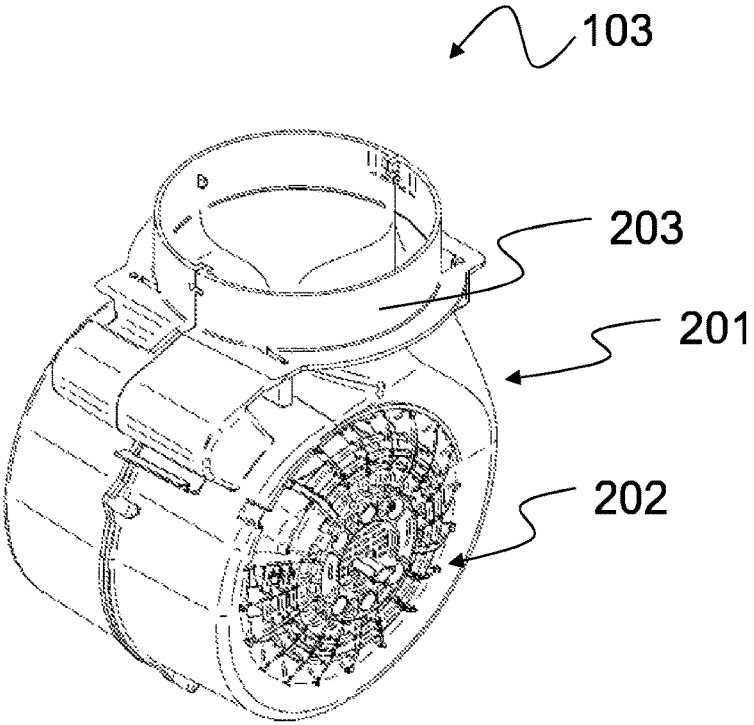
FIG. 2 shows in more detail a suction device for a hood, according to the present invention.

FIG. 2 shows in more detail the suction device 103.

The suction device 103 comprises a volute 201, housing an electric motor and an impeller that is driven by the motor.

The suction device 103 is configured as to suck an airflow from a grid 202 and direct it into the outflow collar 203.

The outflow collar 203 is configured to be mated with the fluid of the extraction tube 104 of the hood 101, whereas the grid 202 sucks the air coming from the smoke collector 102. The outflow collar (or flange) is typically vertical, connecting directly to the extraction tube 104.

Figure 3:
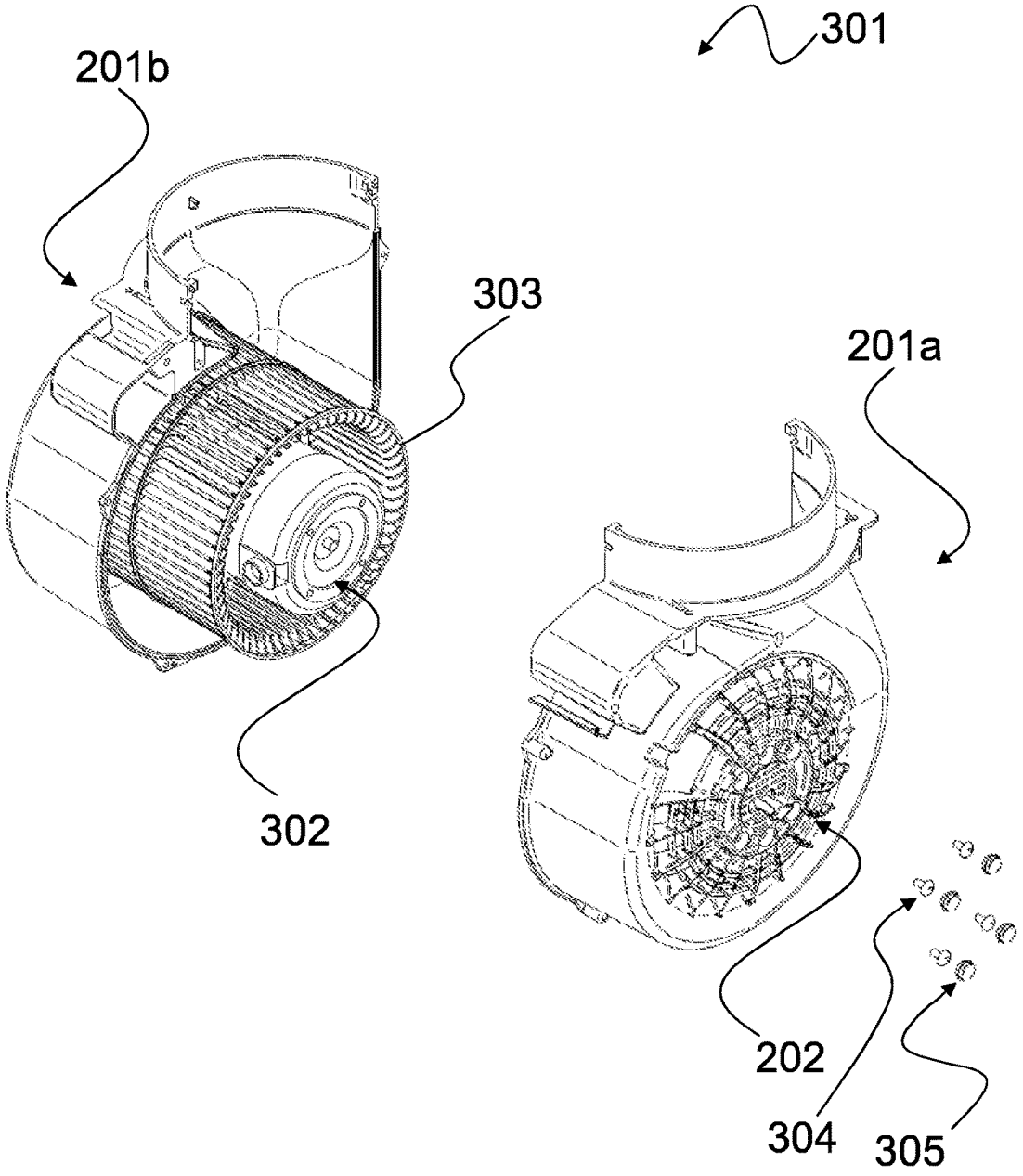
FIG. 3 shows the assembly of a suction device, with a first type of motor.

FIG. 3 shows an embodiment of a suction device 301, with a first type of cylindrical motor.

The suction device 301 comprises a volute 201, which is preferably realised by two hemishells 201*a* and 201*b*, in particular realised in plastic material by moulding.

Inside the volute 201, the suction device 301 comprises an electric motor 302, and an impeller 303 driven by the electric motor 302.

In particular, the electric motor 302 has a substantially cylindrical shape. According to a preferred embodiment of the electric motor 302, such motor is of the type known as "S-type". In particular, the electric motor 302 is of the condenser type.

In the embodiment shown, the motor 302 has a front closure cup, having a circular shape, already inserted.

The motor 302 is inserted into the volute 201, being fastened to it, inter alia, by means of the use of four screws 304 going through four specific holes on the hemishell 201*a*, which engage with respective four threaded holes of the motor 302.

In addition, the suction device comprises four cover elements, such as caps 305, which electrically insulate the screws 304 against incidental contacts outside the suction device 301.

Once assembled, the volute 201 housing the motor 302 and the impeller 303 substantially realises a perfectly functional suction device 301.

Figure 4:
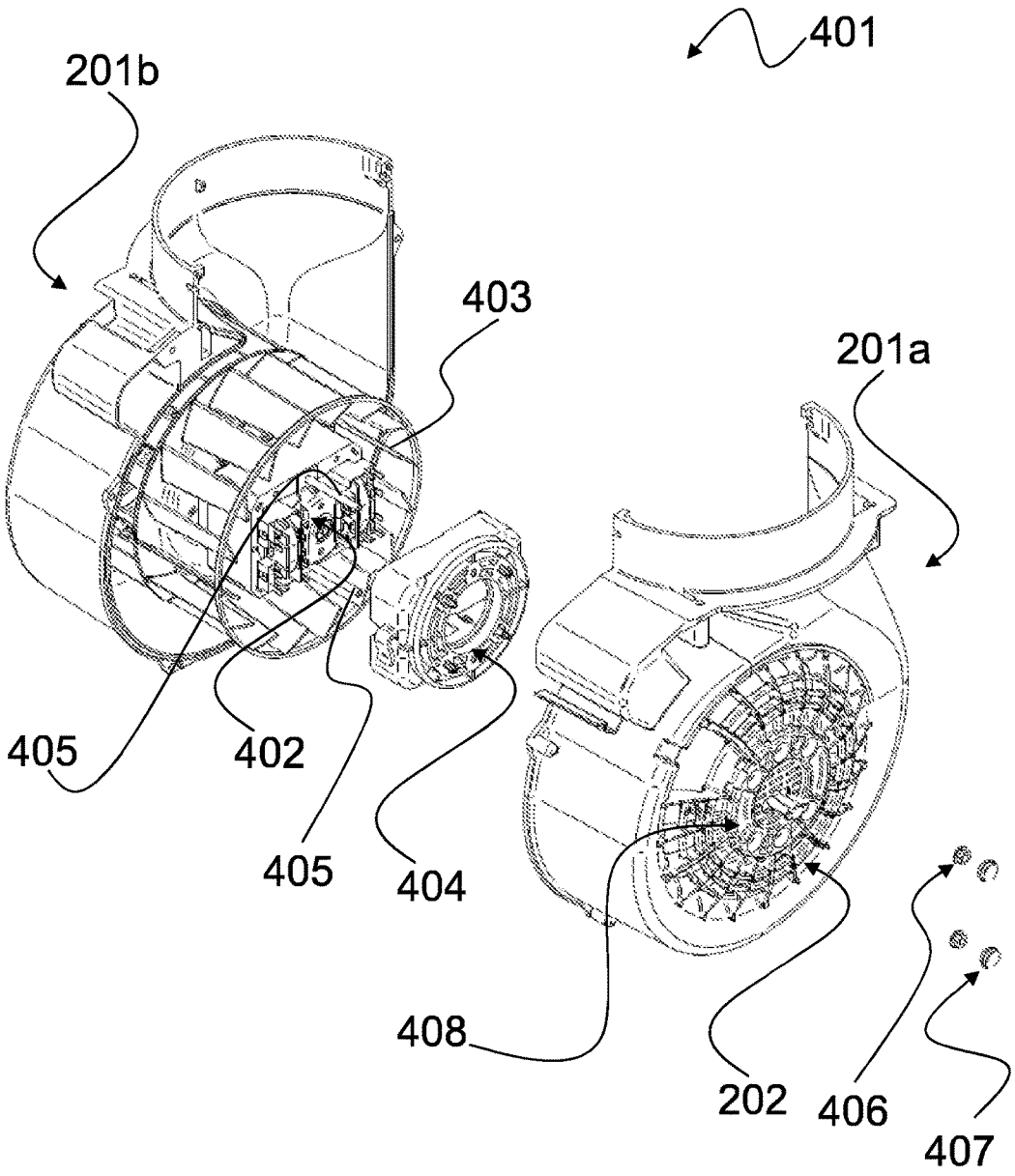
FIG. 4 shows the assembly of a suction device, with an adapter and a second type of motor.

FIG. 4 shows an embodiment of a suction device 401, with a second type of parallelepiped motor, and an adapter according to the present invention.

The suction device 401 comprises a same volute 201, which is preferably realised by two hemishells 201*a* and 201*b*, in particular made of plastic material by moulding.

Inside the volute 201, the suction device 401 comprises an electric motor 402, and an impeller 403 driven by the electric motor 402.

In particular, the electric motor 402 has a substantially parallelepiped shape. According to a preferred embodiment of the electric motor 402, such motor is of the type known as "K-type". In particular, the electric motor 402 has coils protruding from the motor pack, with a square or rectangular pack.

The motor 402 is inserted into the volute 201, from the side of the hemishell 201*b*, inside the impeller 403. In the embodiment shown, the motor 402 is devoid of front closure.

It should be noted that, as the motor 402 is different from the motor 302, the impeller 403 is also different from the impeller 303, previously described. Generally, the motor 402 and the motor 302 may have characteristic power and curves that are different from each other.

The suction device 402 further comprises an adapter 404, configured to engage, on one side, with the electric motor 402, and to mate, on the other side, with the hemishell 201*a* of the volute 201.

The adapter 404 comprises a plurality of through holes, in particular two through holes, as to allow the passage of the two through screws 405, protruding from the motor 402.

The screws 405, preferably metric screws, are of such a length that they go through the adapter 404 and escape from specific holes on the hemishell 201*a* of the volute 201, in particular in correspondence to the grid 202.

Such screws 405 are fastened to the volute 201 by using two threaded nuts 406, fastened on the screws 405 on the adapter and then on the hemishell 201*a*; consequently, the assembly of the motor 402 inside the volute 201 is done by inserting the adapter 404, and by using threaded junctions 405 and 406.

In addition, the suction device 401 comprises two cover elements, such as caps 407, which electrically insulate the screws 405 and the bolts 406 against incidental electric contacts, outside the suction device 401.

Once assembled, the volute 201 housing the motor 402, the impeller 403 and the adapter, substantially realises a perfectly functional suction device 401.

In particular, it may be observed that the volute 201, i.e., the hemishell 201*a*, comprises six holes 408 that are arranged circumferentially on the surface of the volute to which an end of the adapter 404 is proximal.

The holes 408 are primarily configured to allow the passage of the threaded connections described above 304, 405 and 406. Such holes 408 have further functions that will be described below.

Figure 5:
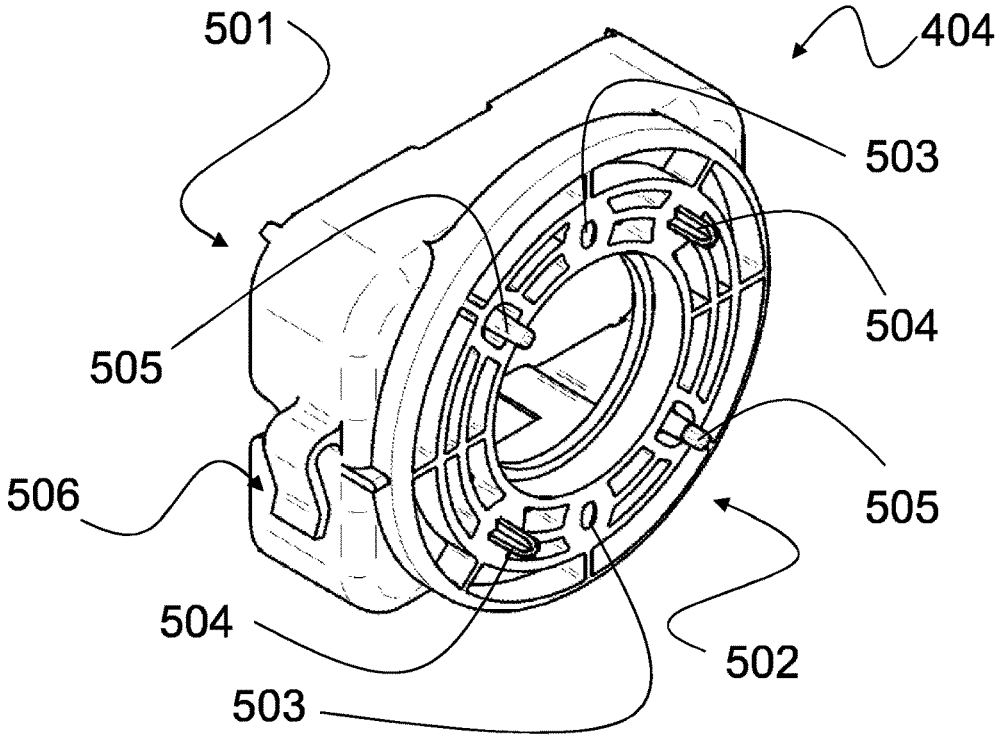
FIG. 5 shows a perspective view of the adapter.

FIG. 5 shows in more detail a perspective view of the adapter 404.

The adapter 404 comprises a substantially rectangular first shaped end 501. Such end 501 is configured to engage with the electric motor 402. The adapter 404 further comprises a substantially circular second shaped end 502. Such end 502 is configured to mate with the volute 201, in particular with the inner surface of the hemishell 201*a*. Furthermore, in particular, such end 502 has a shape substantially similar to the shape of the electric motor 302, in particular of the related cover. In this way, it is possible to house, into the volute 201, both the motor for which the volute is shaped in itself, i.e., the cylindrical motor 302, and the parallelepiped electric motor 402, by means of the interposition of the adapter 404, as described above.

Thanks to the adapter 404, it thus becomes possible to allow the use of the same volute 201 in association with different types of motors, assuring mounting stability to the suction device assembly, and, at the same time, making the volute 201 more versatile and combinable with different types of motors.

Preferably, the adapter 404 is made of plastic material, such as polypropylene. In particular, the adapter 404, in a preferred embodiment, shown in the figure, comprises hollow portions of lightening and stiffening ribs.

The adapter 404 further comprises a plurality of through holes 503, in particular two through holes, which are configured as to allow the screws 405, associated with the electric motor 402, go through them. Such through holes 503 thus allow to fasten the motor 402 to the volute 201, interposing the adapter 404, as to improve the assembly.

In particular, the through holes 503 are slots which have a substantially elliptical section; in this way, the passage of the screws 405 inside the slot 503 is allowed, preferably in such a way that the thread of the screw 405 makes a limited negative allowance with the inner slot side 503. The slight effort for inserting the screws 405 into the slots 503 allows to improve the tightness of the motor/adapter assembly, and thus to improve the stability of the whole suction device 401.

Preferably, the through holes 503 are diametrically aligned each other with respect to the centre of the end 502.

The adapter 404 further comprises two guiding elements 504, protruding from the end 502, being configured to be inserted into holes of the volute 201; such guiding elements 504 act as centering pins, for guiding the assembly of the adapter 404 to the volute, making the assembly easier.

Preferably, the guiding elements 504 are diametrically aligned each other with respect to the centre of the end. 502.

Furthermore, the adapter 404 further comprises two hooking elements 505, protruding from the end 502, being configured to hook with respective holes of the volute 201; such hooking elements 505 are preferably constituted by resilient hooks, connecting the adapter 404 to the volute 201 by hooking it, as to allow an easier assembly.

Preferably, the hooking elements 505 are diametrically aligned each other with respect to the centre of the end 502.

In a preferred embodiment, the guiding elements 504 and the hooking elements 505 are configured to be housed in the four holes 408 of the hemishell 201*a* of the volute 201; such four holes are those that remain free from the screws 405, which, instead, go through the holes in correspondence to the slots 503.

In this way, the four free holes 408 can house both the guiding elements 504 and the hooking elements 505, if the adapter 404 is inserted with the motor 402, or they can house the four screws 304 fastening the motor 302 (without the need for the adapter 404).

Once again, these arrangements allow to realise a volute 201 which, having six holes available, allows the fastening with the maximum adaptability to the different types of motors 302 and 402, depending on the situation and the presence of the adapter 404.

In the end, the adapter 404 comprises a further element 506 for collecting electric cables that may be present in proximity to the electric motor 402.

Figure 6:
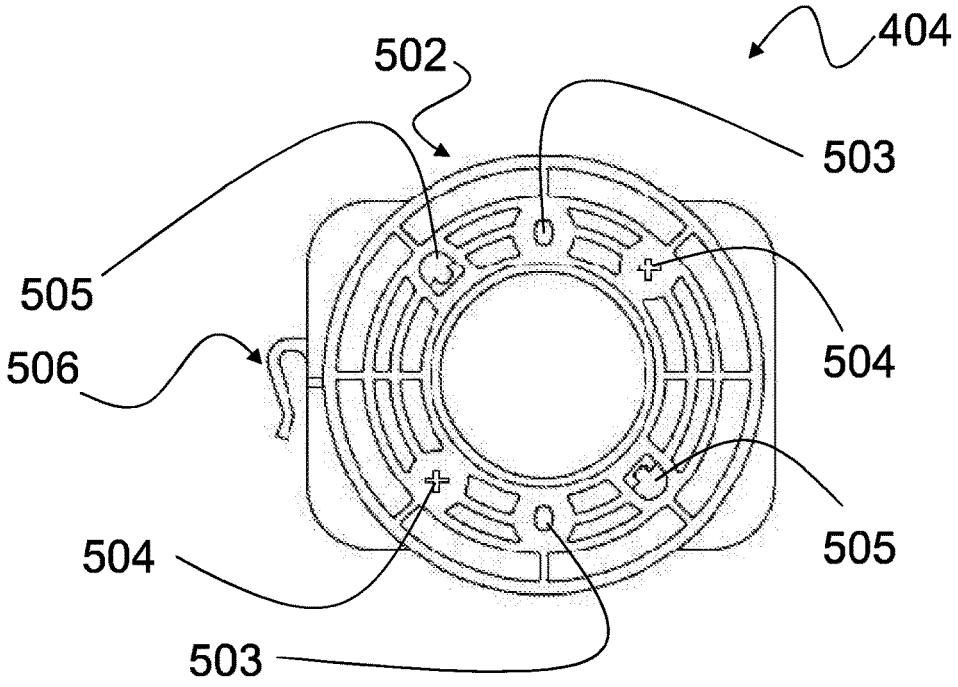
FIG. 6 shows a front view of the adapter.

FIG. 6 shows a front view of the adapter 404, wherein it is possible to observe the cross shape of the guiding elements 504.

Figure 7:
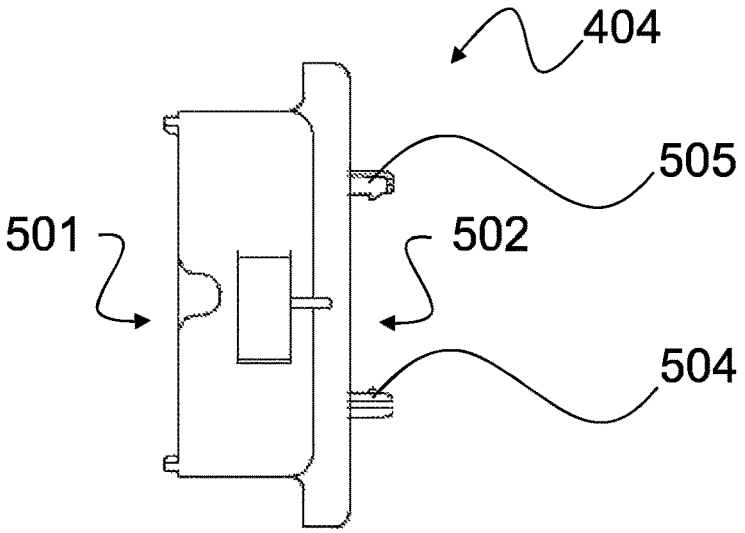
FIG. 7 shows a side view of the adapter.

FIG. 7 shows a side view of the adapter 404, wherein it is possible to observe the arrangement of the first shaped end and configured as to engage with the electric motor 402, and it is also possible to observe the arrangement of the second shaped end and configured as to mate with the volute 201, in particular with the inner surface of the hemishell 201*a*.

Figure 8:
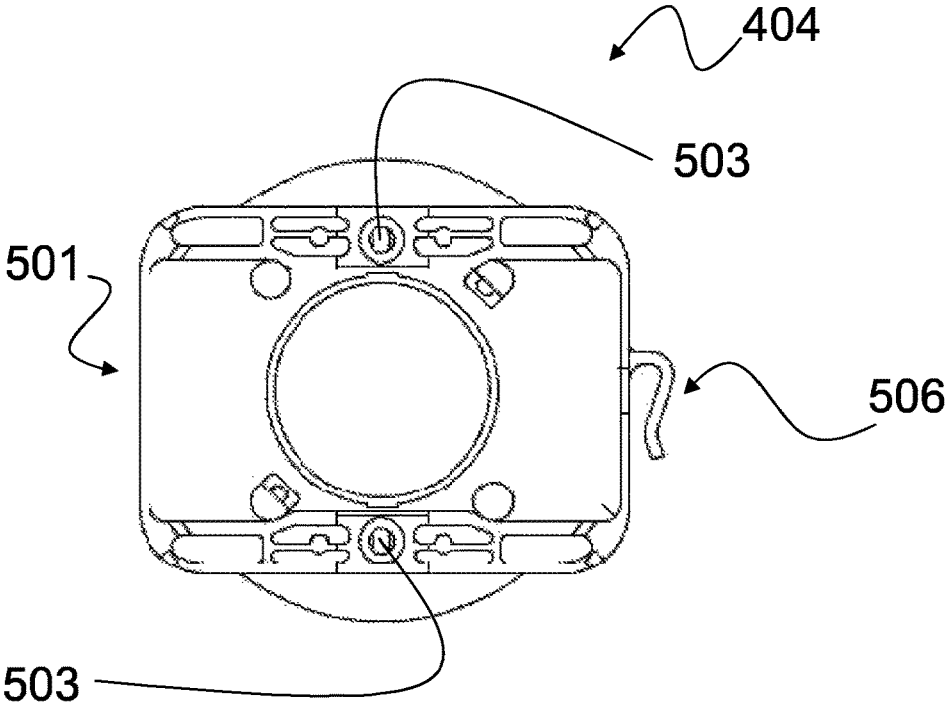
FIG. 8 shows a rear view of the adapter.

FIG. 8 shows a rear view of the adapter 404, wherein it is possible to observe the arrangement of the through holes 503 that go through it, and that allow the passage of the screws 405 associated with the motor 402.

Generally, the impeller 303 or 403 of the suction device may be realised according to different implementations, comprehensible to the person skilled in the art, in particular related to the field of centrifugal fans with axial suction.

It is evident that, according to the teachings of the present description, the person skilled in the art may conceive further variants of the present invention, without however departing from the scope of protection set out in the appended claims.

By way of example, the presence of two screws for one type of the electric motor and of four screws for another type of electric motor, is an example of a preferred embodiment, but different implementations may be possible, wherein a different number of screws, both different and equal to each other, are provided.

Generally, the details of the embodiment given in the present description, by way of an example, may be modified by the person skilled in the art, according to the teachings in the prior art.

In particular, a range hood according to the present invention can use the teachings in the prior art with regard to materials, details of the embodiment, provision and functionality: the general aspects of the range hood, described herein or not, may be subject to various modifications, without departing from the spirit and scope of the present invention.

The invention claimed is:

1. An adapter for a suction device having an electric motor that drives an impeller and a volute that houses said electric motor and said impeller, the adapter comprising:

a substantially rectangular first shaped side having a first side exterior surface configured to engage with said electric motor of the suction device that drives said impeller;

a substantially circular second shaped side having a second side exterior surface configured to mate with said volute of the suction device that houses said electrical motor and said impeller, wherein the substantially rectangular first shaped side and the substantially circular second shaped side are opposite sides of the adapter; and a plurality of through holes for fastening said electric motor to said volute.

2. The adapter according to claim 1, further comprising at least two guiding elements protruding from said substantially circular second shaped side, said at least two guiding elements being configured to be inserted into respective holes of said volute.

3. The adapter according to claim 1, further comprising at least two hooking elements protruding from said substantially circular second shaped side, said at least two hooking elements being configured to hook with respective holes of said volute, thereby connecting said adapter to said volute during assembly of said suction device.

4. The adapter according to claim 1, wherein said plurality of through holes include two slots, both of which have a substantially elliptical section and are so configured as to allow the passage of two respective screws of said electric motor.

5. The adapter according to claim 1, wherein said substantially rectangular first shaped side is configured to engage with said electric motor, which has a substantially parallelepiped shape, and wherein said substantially circular second shaped side has a shape substantially similar to the shape of a different second electric motor, which has a substantially cylindrical shape.

6. A suction device comprising:

an electric motor;

an impeller driven by said electric motor;

a volute adapted to house said electric motor and said impeller; and an adapter including:

a substantially rectangular first shaped side configured to engage with said electric motor that only engages with one side of the adapter, a substantially circular second shaped side configured to mate with said volute, wherein the substantially rectangular first shaped side and the substantially circular second shaped side are opposite sides of the adapter, and a plurality of through holes for fastening said electric motor to said volute.

7. The suction device according to claim 6, wherein said electric motor has a substantially parallelepiped shape suitable for fitting into said substantially rectangular first shaped side of said adapter, and includes two protruding screws configured to go through said adapter and be fastened to said volute.

8. The suction device according to claim 6, wherein said volute includes six holes arranged circumferentially on the surface of said volute which is proximal to said substantially circular second shaped side of said adapter.

9. The suction device according to claim 8, wherein two of said six holes are configured to house screws for fastening said electric motor.

10. The suction device according to claim 9, wherein each one of the remaining four of said six holes is configured to alternately house: a guiding element or a hooking element of said adapter, or a screw for a different second electric motor, which is insertable into said suction device without using said adapter, said second electric motor having a substantially cylindrical shape.

11. The suction device according to claim 6, further comprising cover elements configured to cover and electrically insulate screws protruding from said volute.

12. A range hood, comprising a suction device having an electric motor, an impeller driven by said electric motor, and a volute adapted to house said electric motor and said impeller; and an adapter having a substantially rectangular first shaped side configured to engage with said electric motor, a substantially circular second shaped side configured to mate with said volute, and a plurality of through holes for fastening said electric motor to said volute, wherein the substantially rectangular first shaped side and the substantially circular second shaped side are opposite sides, wherein the adapter includes at least two hooking elements protruding from said second shaped side, said at least two hooking elements being configured to hook with respective holes of said volute, thereby connecting said adapter to said volute during assembly of said suction device.

13. The adapter according to claim 2, wherein said plurality of through holes include two slots, both of which have a substantially elliptical section and are so configured as to allow the passage of two respective screws of said electric motor.

14. The adapter according to claim 3, wherein said plurality of through holes include two slots, both of which have a substantially elliptical section and are so configured as to allow the passage of two respective screws of said electric motor.

15. The adapter according to claim 2, wherein said substantially rectangular first shaped side is configured to engage with said electric motor, which has a substantially parallelepiped shape, and wherein said substantially circular second shaped side has a shape substantially similar to the shape of a different second electric motor, which has a substantially cylindrical shape.

16. The adapter according to claim 3, wherein said substantially rectangular first shaped side is configured to engage with said electric motor, which has a substantially parallelepiped shape, and wherein said substantially circular second shaped side has a shape substantially similar to the shape of a different second electric motor, which has a substantially cylindrical shape.

17. The adapter according to claim 4, wherein said substantially rectangular first shaped side is configured to engage with said electric motor, which has a substantially parallelepiped shape, and wherein said substantially circular second shaped side has a shape substantially similar to the shape of a different second electric motor, which has a substantially cylindrical shape.

18. The suction device according to claim 7, wherein said volute includes six holes arranged circumferentially on the surface of said volute which is proximal to said substantially circular second shaped side of said adapter.

19. The suction device according to claim 7, further comprising cover elements configured to cover and electrically insulate screws protruding from said volute.

* * * * *